US011457780B1

(12) United States Patent
Wright

(10) Patent No.: US 11,457,780 B1
(45) Date of Patent: Oct. 4, 2022

(54) REARWARD-FACING TOILET

(71) Applicant: Steve Wright, Malibu, CA (US)

(72) Inventor: Steve Wright, Malibu, CA (US)

( * ) Notice: Subject to any disclaimer, the term of this patent is extended or adjusted under 35 U.S.C. 154(b) by 0 days.

(21) Appl. No.: 17/124,997

(22) Filed: Dec. 17, 2020

Related U.S. Application Data

(60) Provisional application No. 62/948,873, filed on Dec. 17, 2019.

(51) Int. Cl.
*A47K 17/02* (2006.01)
*E03D 11/02* (2006.01)

(52) U.S. Cl.
CPC ..... *A47K 17/028* (2013.01); *A47K 17/026* (2013.01); *E03D 11/02* (2013.01)

(58) Field of Classification Search
CPC ..... A47K 13/00; A47K 13/005; A47K 13/06; A47K 13/24–28; A47K 17/02; A47K 17/022–028; A47K 2017/006; E03D 1/01–0125; E03D 1/14–145; E03D 11/00; E03D 11/02; E03D 11/04; E03D 11/11; E03D 11/13; E03D 13/002; E03D 13/005; E03D 2201/00
See application file for complete search history.

(56) References Cited

U.S. PATENT DOCUMENTS 2,185,887 A 1/1940 Dennis
4,012,797 A * 3/1977 Kristoffersen ..... E03D 11/04 4/300
5,282,279 A * 2/1994 Hinton ..... A47K 17/028 4/144.1
5,594,957 A * 1/1997 Shih ..... A47K 13/00 D23/311
5,809,583 A 9/1998 Pucciani
6,516,475 B1 2/2003 Anderson
6,571,399 B1 6/2003 Wagener
7,194,772 B2 3/2007 Rie
7,454,801 B1 11/2008 Rie
7,458,110 B2 * 12/2008 Rie ..... A47K 13/24 4/254

(Continued)

FOREIGN PATENT DOCUMENTS

DE 463664 * 8/1928 ..... A47K 17/028
GB 829981 * 3/1960 ..... E03D 11/13
JP 2001204652 * 7/2001 ..... A47K 17/026

OTHER PUBLICATIONS

Mount Nelson Ayala's Loo for More Sanitary Squatting. Product Listing [online]. Trends © 2020 Trend Hunter Inc. [published on Apr. 24, 2009; retrieved on Jul. 24, 2019]. Retrieved from the Internet; <URL: https://www.trendhunter.com/trends/rocking-new-toilet-hovering-made-easier-for-sanitary-squating>.

(Continued)

*Primary Examiner* — David P Angwin
*Assistant Examiner* — Nicholas A Ros
(74) *Attorney, Agent, or Firm* — Cramer Patent & Design, PLLC; Aaron R. Cramer

(57) ABSTRACT

A rear-facing toilet is a toilet having a seat which is positioned such that a user faces the tank when sitting. The toilet further has leg lifting portions which assist in elevating the knees of a user on the toilet. The top of the tank may serve as a worktable or storage tray. Footrests and foot ramps are provided about the base of the toilet permitting a user to rest his or her feet while the toilet is in use.

12 Claims, 5 Drawing Sheets

(56) References Cited

U.S. PATENT DOCUMENTS

| | | | | |
|---|---|---|---|---|
| 8,075,059 | B2 * | 12/2011 | Kim | A47C 1/146 297/378.12 |
| 8,230,531 | B2 * | 7/2012 | Miller | E03D 9/10 4/319 |
| 8,484,770 | B2 | 7/2013 | Desai | |
| 8,607,369 | B1 | 12/2013 | Al-Khattaf | |
| 9,661,963 | B2 | 5/2017 | Desai | |
| 9,848,744 | B1 * | 12/2017 | Hobbs | A47K 13/12 |
| 10,307,024 | B2 * | 6/2019 | Seibt | A47K 17/02 |
| 2010/0031429 | A1 * | 2/2010 | Kim | A47K 17/026 4/300 |
| 2015/0096114 | A1 * | 4/2015 | Wisdom | E03D 11/00 4/353 |
| 2018/0338652 | A1 * | 11/2018 | Erkelens | E03D 11/04 |
| 2020/0165805 | A1 * | 5/2020 | Nair | E03D 11/02 |
| 2020/0229653 | A1 * | 7/2020 | Williams | A47K 3/282 |

OTHER PUBLICATIONS

<Untitled>. Product Listing [online]. Facebook [published on Apr. 1, 2015; retrieved on Jul. 24, 2019]. Retrieved from the Internet; <URL: https://www.facebook.com/JsgPlumbingHeatingLtd/photos/pcb.794989747251391/794989713918061/?type-3&amp%3Btheater>.

Sitting toilet design Product Listing [online] © 2020 Home Designs Project [retrieved on Jul. 24, 2019]. Retrieved from the Internet; <URL: https://www.floatproject.org/closet/toilet-interior-design/attachment/sitting-toilet-design>.

* cited by examiner

REARWARD-FACING TOILET

RELATED APPLICATIONS

The present invention was first described in and claims the benefit of U.S. Provisional Patent Application No. 62/948,873 filed on Dec. 17, 2019, the entire disclosures of which are incorporated herein by reference.

FIELD OF THE INVENTION

The present invention relates generally to a toilet and more specifically to a rearward-facing toilet.

BACKGROUND OF THE INVENTION

The act of going to the bathroom and producing a bowel movement is generally unpleasant to discuss but is something we all must deal with. As mankind has become more civilized, we have progressed from performing such bowel movements while squatting in the woods, to sitting upright while on a toilet.

However, there is a line of thinking that the upright and sitting position for bowel movements has had detrimental effects on human health due to the "kinks" in the colon and rectum during a bowel movement. These restrictions have resulted in bowels that are less cleansed and more prone to developing ailments and disease. Accordingly, there exists a need for a means by which the human body can be placed in a position that simulates the squatting position while performing a bowel movement on a toilet. The development of the rearward-facing toilet fulfills this need.

SUMMARY OF THE INVENTION

To achieve the above and other objectives, the present invention provides for a rearward-facing toilet having a tank assembly which has an upper tank portion and a lower tank portion, a bowl assembly which is assembled as a unitary structure with the tank assembly, a seat area which is located at an upper portion of the bowl assembly, a hinge assembly which hingedly attaches the toilet seat to the rear of the seat area, a pair of foot ramps which are disposed on either side of a bottom portion of a bowl area adjacent to a bottom of the lower tank portion, a pair of foot rests which have a first foot rest and a second foot rest, a pair of armrests which are mounted to opposing outer sides of the upper tank portion adjacent to a flat top that are vertically aligned with each other and a pair of dual flush buttons which are mounted on either side of the upper tank portion directly above the armrests.

The pair of dual flush buttons are in fluid communication with and operably control a water supply to the rearward-facing toilet and the dual flush buttons include a first button and a second button. The seat area includes a toilet seat and a toilet seat lid. The seat area includes an elongated and wider seat rim design than that found on a conventional toilet and provides access to a bowl interior that is easier and more comfortable to use, especially for a user that is large and/or obese. The toilet seat is shaped to cover the rim of the seat area. The pair of footrests are disposed on each of the pair of foot ramps.

The tank assembly may be made of a material selected from the group consisting of porcelain, polyvinyl chloride, or acrylonitrile butadiene styrene plastic. The upper end of the upper tank portion may include the flat top to allow the user to lean against during use. The bowl assembly may be fabricated as a unitary structure with the bowl assembly. The bowl assembly may be made of a material selected from the group consisting of porcelain, polyvinyl chloride, or acrylonitrile butadiene styrene plastic. The toilet seat lid may be shaped to cover the toilet and is horizontally bifurcated into a seat lid front half and a seat lid rear half. The toilet seat rear half may be hingedly attached to the rear of the seat area with the common hinge assembly.

The toilet seat lid may be provided with a center hinge that conjoins the seat lid front half to the seat lid rear half, thereby allowing the toilet seat lid to fold inward upon itself when in a raised position. A pair of release buttons may be provided at the distal ends of the center hinge which are pressed to allow for the folding action to occur. The seat lid rear half may rest against the front surface of the upper tank half while the seat lid front half may rest against the seat lid rear half to remain out of the way of the user during use, while still allowing for covering the bowl area for aesthetic, protective, and sanitary purposes when not in use.

An opening to the bowl interior may be seven inches across, with a seat width of three and a half inches. The pair of foot ramps may be adapted to ergonomically accommodate a plurality of different sized users. The first footrest may be positioned at a rear portion of the foot ramp and may be intended to enable a tip of the foot of the user to rest at a downward position. The second footrest may be positioned at a rear portion of the foot ramp and may be intended to enable a tip of the foot of the user to rest at a downward position. The footrests may include a plurality of molded ridges. The footrests are made of a texturized material.

The pair of armrests may be adapted to assist the user mounting or dismounting the rearward-facing toilet. The pair of armrests may be adapted to rest a pair of user's arms during use of the rearward-facing toilet. The first button may allow for a brief discharge of water to pre-wet the bowl area before use of the rearward-facing toilet prior to a bowel movement in an effort to make cleaning of the bowl area easier. The second button may allow for a complete flush in a conventional manner.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
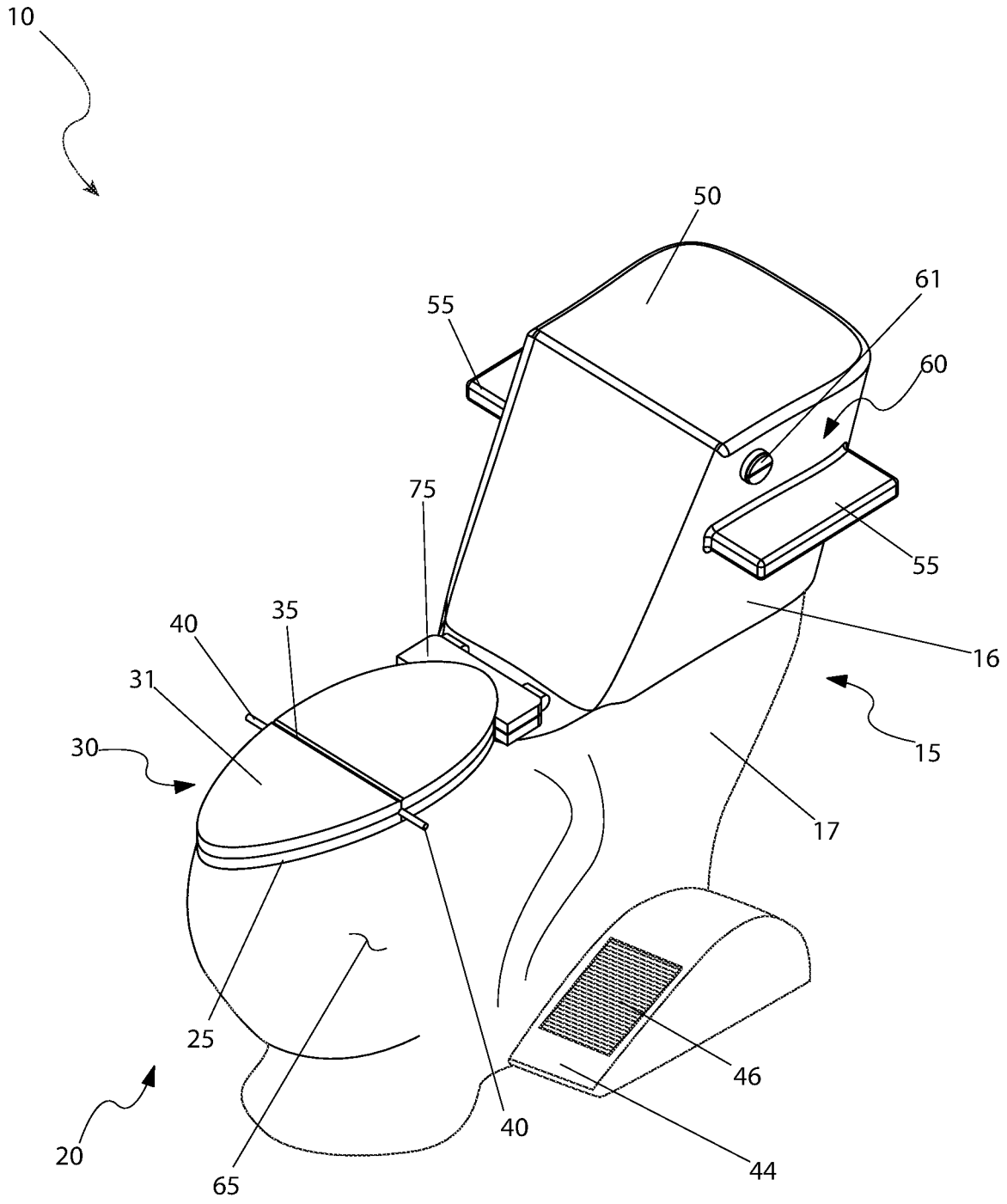
FIG. 1 is a perspective view of the rearward-facing toilet, according to the preferred embodiment of the present invention.

10 rearward-facing toilet
15 tank assembly
16 upper tank portion

17 lower tank portion
20 bowl assembly
25 seat area
30 toilet seat lid
31 seat lid front half
32 seat lid rear half
35 center hinge
40 release button
46 footrest
50 flat top
55 armrest
60 dual flush button
61 first button
62 second button
65 bowl area
70 toilet seat
75 common hinge assembly
80 wall
90 floor
95 user
100 seated position
105 foot
110 personal item
115 knee
120 hip
125 flush valve
130 rim outlet
135 exit drain
140 trap
145 drain coupling
150 fill mechanism

DESCRIPTION OF THE INVENTION

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the Figures

Referring now to FIG. 1, a perspective view of the rearward facing ergonomic toilet 10, according to the preferred embodiment of the present invention is disclosed. The rearward-facing toilet 10 (herein also described as the "toilet") 10, includes a tank assembly 15 and a bowl assembly 20. Both the tank assembly 15 and the bowl assembly 20 are envisioned to be made of porcelain. However, other materials such as polyvinyl chloride (PVC), and acrylonitrile butadiene styrene (ABS) plastic may be used with equal success. As such, the materials of construction as used with the toilet 10 is not intended to be a limiting factor of the present invention.

The tank assembly 15 comprises an upper tank portion 16 and a lower tank portion 17 assembled or fabricated as a unitary structure with the bowl assembly 20. The seat area 25 is located at the upper portion of the bowl assembly 20 and includes a toilet seat 70 and a toilet seat lid 30. The seat area 25 provides for an elongated and wider seat rim design than that found on a conventional toilet and provides access to a bowl interior. It is envisioned that the opening to the bowl interior is approximately seven inches (7 in.) across, with a seat width of approximately three and a half inches (3-%/2 in.) around. As such, the toilet 10 is easier and more comfortable to use, especially with large and/or obese users. The toilet seat 70 is shaped to cover the rim of the seat area 25 and is hingedly attached to the rear of the seat area 25 via a common hinge assembly 75. The toilet seat lid 30 is shaped to cover the toilet 70 and is horizontally bifurcated into a seat lid front half 31 and seat lid rear half 32. The toilet seat rear half 32 is also hingedly attached to the rear of the seat area 25 with the common hinge assembly 75. The toilet seat lid 30 is provided with a center hinge 35 that conjoins the seat lid front half 31 to the seat lid rear half 32, thereby allowing the toilet seat lid 30 to fold inward upon itself when in the raised position. Two (2) release buttons 40 are provided at the distal ends of the center hinge 35, either of which may be pressed to allow for the folding action to occur.

The toilet 10 is designed to be used with the user facing the tank assembly 15 and will be described in greater detail herein below. A pair of foot ramps 44 are located on either side of the bottom portion of the bowl area 65 adjacent to the bottom of the lower tank portion 17. A foot 105 of a user 95 may be placed upon either a footrest 46 both located on the foot ramp 44 (of which only one (1) is shown due to illustrative limitations) to allow for variable placement of the foot 105 depending on the size of the user 95 and range of motion. The footrest 46 is positioned at a rear portion of the foot ramp 44 and is intended to enable the tips of the foot 105 of a user 95 to rest at a downward position and the footrest 46 is positioned at a front of the foot ramp 44 and is intended to enable the tips of the foot 105 to rest at an upward position. The footrest 46 are preferably molded ridges or other texturized material as part of the respective foot ramp 44. Other embodiments can provide for texturized decals or adhesive features being placed on smooth surfaces of the foot ramps 44 at desired locations thereof.

The upper end of the upper tank portion 16 is provided with a flat top 50 to primarily allow the user 95 to lean against during use. It may also be used for placement of items including, but not limited to: cellular phones, reading material, beverages, and the like. A set of two (2) armrests 55 are mounted to opposing outer sides of the upper tank portion 16 adjacent to the flat top 50, and preferably vertically aligned with each other. The armrests 55 to be used when mounting or dismounting the toilet 10. The armrests 55 may also be utilized by the user 95 to rest their arms during use of the toilet 10. Two (2) dual flush buttons 60 are mounted on either side of the upper tank portion 16 directly above the armrests 55 and are in fluid communication with and operably control a water supply to the toilet 10. The dual flush buttons 60 include a first button 61 and a second button 62. The first button 61 is envisioned to allow for a brief discharge of water to pre-wet the bowl area 65 before use of the toilet 10 prior to a bowel movement in an effort to make cleaning of the bowl area 65 easier. The second button 62 is envisioned to allow for a complete (full/heavy) flush in a conventional manner.

Figure 2:
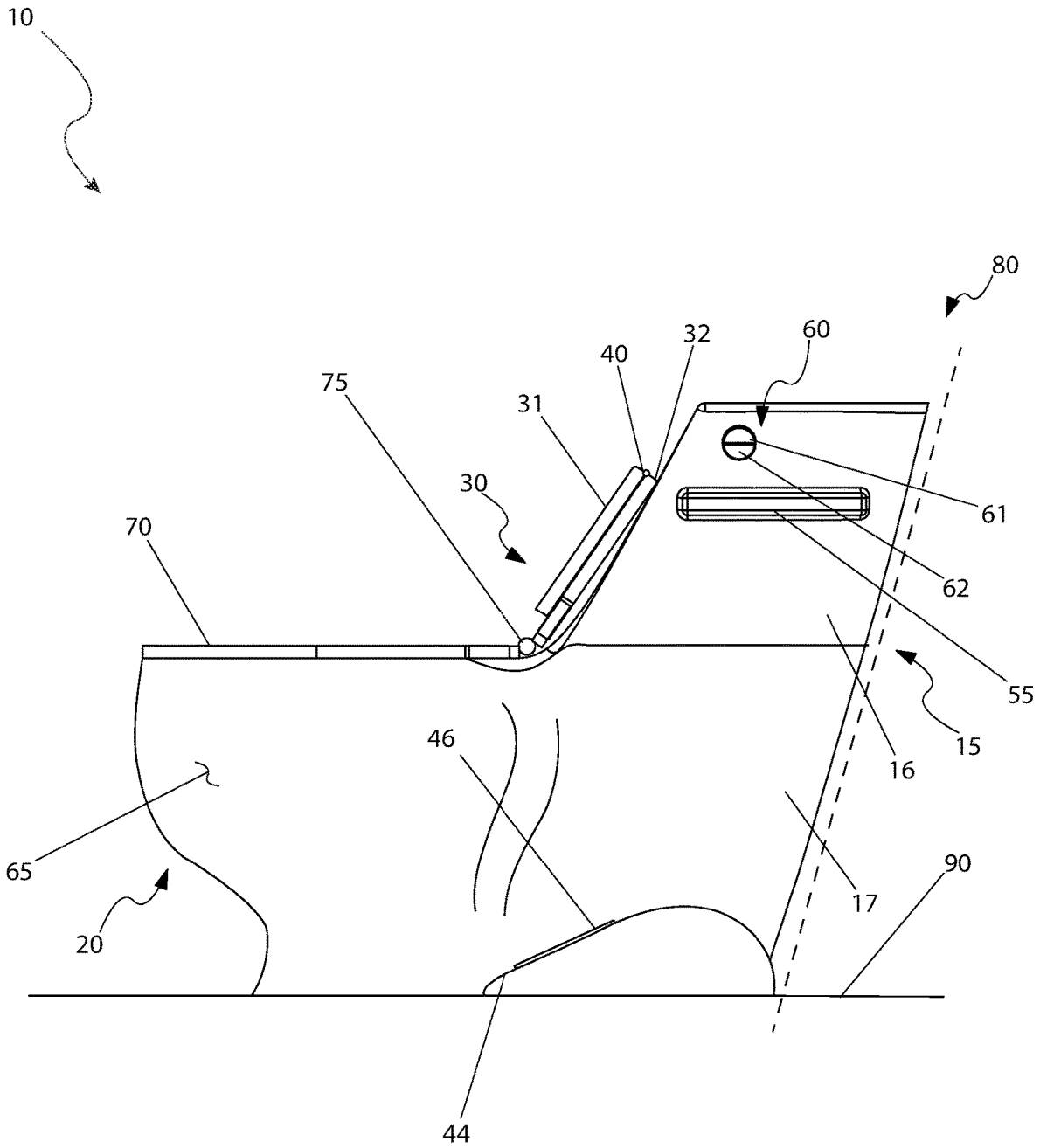
FIG. 2 is a side view of the rearward-facing toilet, according to the preferred embodiment of the present invention.

Referring next to FIG. 2, a side view of the toilet 10, according to the preferred embodiment of the present invention is depicted. This view discloses the toilet seat lid 30 in an up and folded position, where the seat lid rear half 32 rests against the front surface of the upper tank half 16 and the seat lid front half 31 rests against the seat lid rear half 32. This position remains out of the way of the user 95 during use, but still allows for the covering of the bowl area 65 for aesthetic, protective, and sanitary purposes when not in a use. A non-folding toilet seat 70 is provided and functions in the expected customary manner. As aforementioned, the toilet seat 70 and the toilet seat lid 30 are connected to a common hinge assembly 75. The toilet 10 is designed to be placed against a wall 80 as is customary or may be placed facing away from the wall 80 in a one-hundred-eighty degree (180°) manner, and as such, can be used in new construction, retrofit, remodeling and replacement projects. One (1) of the two (2) dual flush buttons 60 are visible above one (1) of the two (2) armrests 55 in this view. One (1) of the two (2) foot ramps 44 are visible. This positioning facing the wall 80 allows for easier access to toilet paper rolls (not shown), assist bars (not shown), bathroom cabinets (not shown), vanities (not shown), and other amenities commonly afforded in a bathroom or restroom environment.

Figure 3:
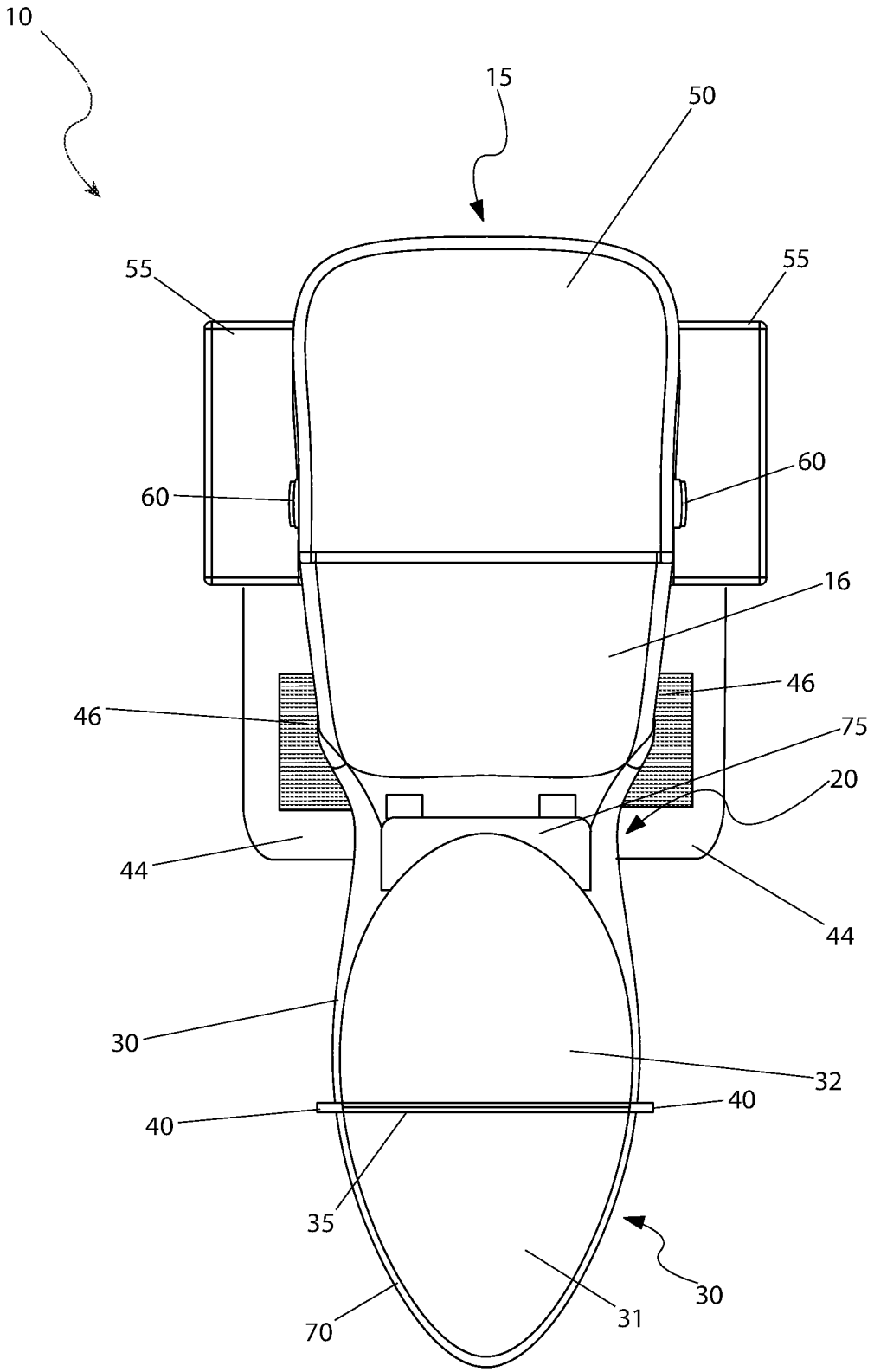
FIG. 3 is a top view of the rearward-facing toilet, according to the preferred embodiment of the present invention.

Referring now to FIG. 3, a top view of the toilet 10, according to the preferred embodiment of the present invention is shown. The top view clearly displays the ample horizontal space available to lean forward on and for temporary storage on the flat top 50 of the tank assembly 15. Both of the armrests 55, as well as both of the dual flush buttons 60, are visible on either side of the flat top 50. The two (2) foot ramps 44 are located alongside of the bowl area 65 in a symmetrical fashion as shown. The toilet seat lid 30 is connected to the common hinge assembly 75 along with the toilet seat 70. The center hinge 35 along with the two (2) release buttons 40 are located at the approximate halfway point of the bowl area 65.

Figure 4:
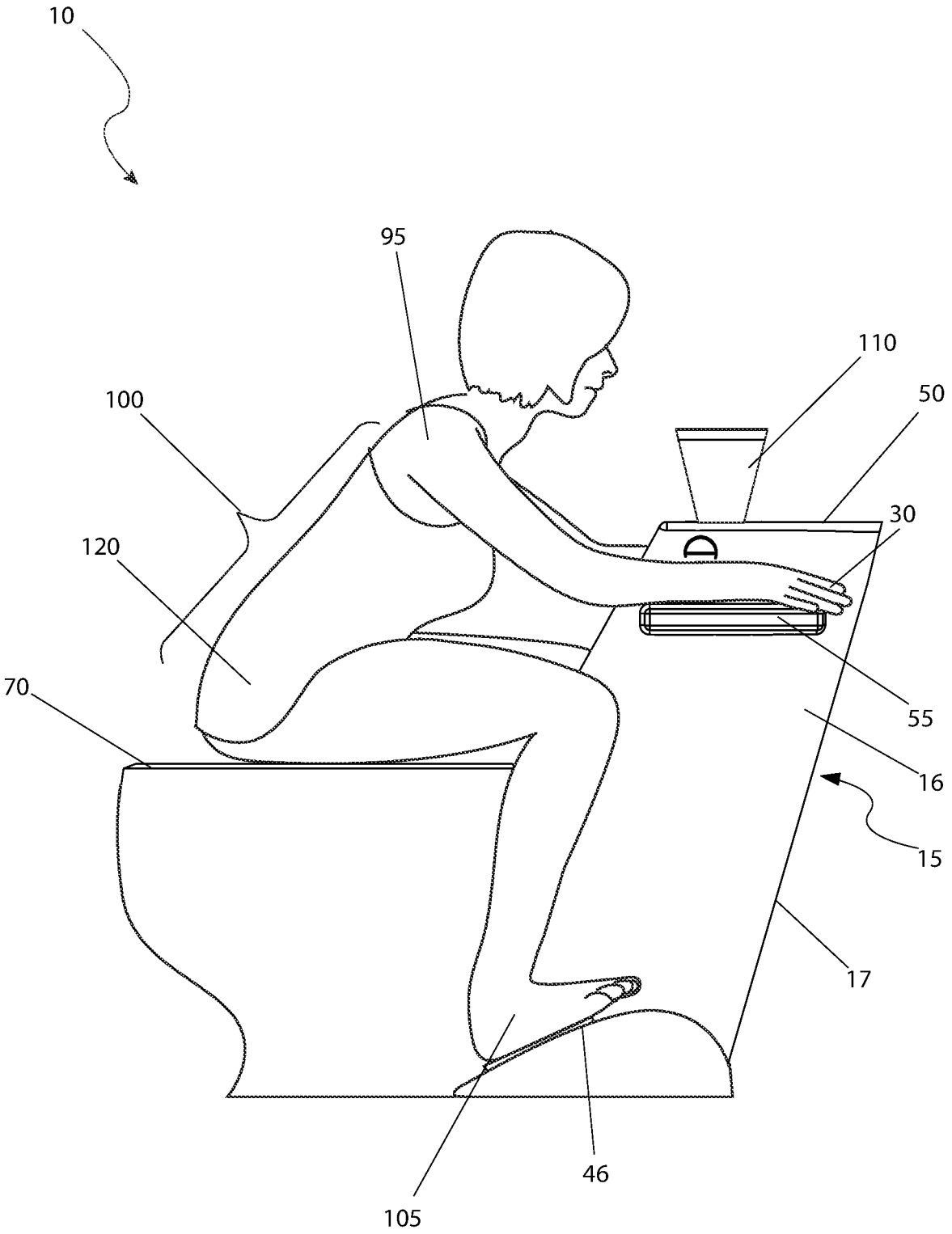
FIG. 4 is a side view of the rearward-facing toilet, shown in a utilized state, according to the preferred embodiment of the present invention.

Referring next to FIG. 4, a side view of the toilet 10, shown in a utilized state, according to the preferred embodiment of the present invention is disclosed. A user 95 is provided in a seated position 100 on the toilet seat 70 with the toilet seat lid 30 in an upward and folded position (as previously depicted in FIG. 2). The foot 105 of the user 95 is positioned upon the foot ramps 44 in a comfortable position, preferably resting on either a footrest 46. Primarily, the user 95 then leans or rests their body against the flat top 50. Secondarily, any personal items 110 may be positioned upon the flat top 50 where they may be easily accessed without twisting or turning as is the case with a conventional toilet. This depicted position, with the knees 115 of the user 95 above that of the hips 120, provide for a more natural position of the bowels and allows for a more complete and rapid evacuation of the bowels. It is noted that flushing the toilet 10 while the user 95 is in a seated position present a more sanitary environment that is hygienically cleaner by reducing the amount of bacteria released from the bowl area 65.

Figure 5:
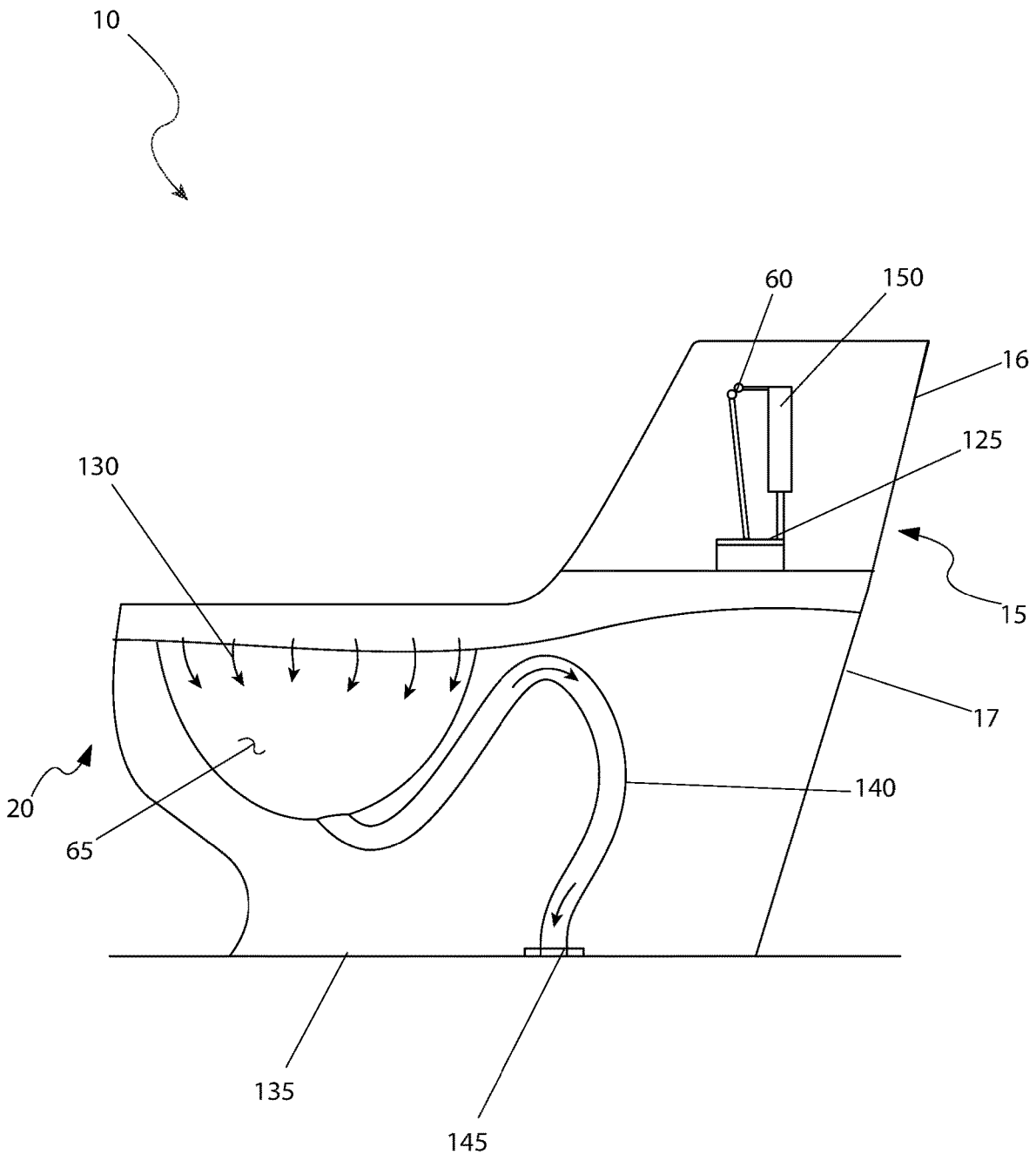
FIG. 5 is a sectional view of the rearward-facing toilet, as seen along a Line I-I, as shown in FIG. 3, according to the preferred embodiment of the present invention.

Referring to FIG. 5, a sectional view of the toilet 10, as seen along a Line I-I, as shown in FIG. 3, according to the preferred embodiment of the present invention is depicted. Flush activation is accomplished by one (1) of the two (2) dual flush buttons 60 which are connected to a flush valve 125. The flush valve 125 allows for both for a partial flush to pre-wet the bowl area 65 when the first button 61 is depressed as well as a full flush when the second button 62 is depressed to completely remove all solids from the bowl area 65. Water from the flush valve 125 is routed through the rim outlets 130 and into the bowl area 65. Waste material is the routed out through the exit drain 135, through a trap 140 and out a drain coupling 145. The drain coupling 145 is of a standard configuration and location, to connect to standard plumbing waste lines. The flush valve 125 is envisioned to be a high efficiency, high-power, low-water usage design for maximum flushing power. The fill mechanism 150 is refilled after each flush by a fill mechanism 150 which operates in the customary and expected manner.

2. Operation of the Preferred Embodiment

The preferred embodiment of the present invention can be utilized by the common user 95 in a simple and effortless manner with little or no training. It is envisioned that the toilet 10 would be constructed in general accordance with FIG. 1 through FIG. 5. The user 95 would procure the toilet 10 from conventional procurement channels such as hardware stores, home improvement stores, plumbing supply houses, mail order and internet supply houses and the like. Special attention would be paid to aesthetic styling, colors, and the like.

After procurement and prior to utilization, the toilet 10 would be prepared in the following manner: the toilet 10 would be installed by standard connection to the drain coupling 145 to waste line plumbing, and a supply water connection to the fill mechanism 150. At this point in time, the toilet 10 will be ready for utilization.

During utilization of the toilet 10, the following procedure would be initiated: the toilet seat lid 30 would be lifted and folded by manipulation of either release buttons 40 and folding the toilet seat lid 30 in a one-hundred-eighty degree (180°) forward manner; the user 95 would then sit upon the toilet seat 70 while facing the tank assembly 15; the user 95 would then place their foot 105 upon the foot ramps 44 to raise their knees 115 above their hips 120; the user 95 would then manipulate the first button 61 to effect the partial release position to pre-wet the interior of the bowl area 65; the user 95 would then lean forward to tank assembly 15, mimicking an angled squat; the user 95 would then evacuate their bowels; finally, the user 95 would wipe and cleanse in a typical manner; and then manipulate the second button 62 to effect a full flush position and then dismount the toilet 10.

After use of the toilet 10, the toilet seat lid 30 is opened into a flat position and manipulated against the common hinge assembly 75 to allow the toilet seat lid 30 to lay flat upon the toilet seat 70. At this point in time, the toilet 10 is ready for additional usage cycles in a typical repeating manner.

It is noted that usage of the toilet 10 not only allows for easier and more complete bowel movements. It also presents a more sanitary environment that is hygienically cleaner by reducing the number of bacteria released from the bowl area 65, by having the user 95 flush the toilet 10 while in a seated position. The following advantages are realized as well: easier access to toilet paper roll holders, assist bars, bathroom cabinets, sink vanities, and other bathroom amenities; access to the flat top 50 allows for storage and subsequent use of the personal items 110, easier mounting and dismounting of the toilet seat 70, and usage by all users 95 including, but not limited to: children, adults, males, females, elderly, disabled, obese, and the like.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A rearward-facing toilet, comprising:

a tank assembly having an upper tank portion and a lower tank portion;

a bowl assembly assembled as a unitary structure with the tank assembly;

a seat area located at an upper portion of the bowl assembly, the seat area includes a toilet seat and a toilet seat lid, the seat area includes an elongated seat rim and the seat area provides access to a bowl interior;

wherein the tank assembly, bowl assembly and seat area are sized and shaped to facilitate use of the toilet by a user in a rearward facing position;

a hinge assembly hingedly attaching the toilet seat to the rear of the seat area, the toilet seat is shaped to cover the rim of the seat area, the toilet seat lid is attached to the hinge assembly;

a first foot ramp and a second foot ramp disposed on either side of and in alignment with a bottom of the lower tank portion;

a first footrest and a second footrest, the first footrest being disposed upon the first foot ramp and the second footrest being disposed upon the second foot ramp;

a pair of armrests mounted to opposing outer sides of the upper tank portion adjacent to a flat top that are vertically aligned with each other; and a pair of dual flush buttons mounted on either side of the upper tank portion directly above the armrests, the pair of dual flush buttons are in fluid communication with and operably control a water supply to the rearward-facing toilet and the dual flush buttons include a first button and a second button;

wherein the toilet seat lid is shaped to cover the toilet and is horizontally bifurcated into a seat lid front half and a seat lid rear half;

wherein the toilet seat rear half is hingedly attached to the rear of the seat area with the hinge assembly;

wherein the toilet seat lid is provided with a center hinge that conjoins the seat lid front half to the seat lid rear half, thereby allowing the toilet seat lid to fold inward upon itself when in a raised position;

wherein a pair of release buttons are provided at the distal ends of the center hinge which are pressed to allow for the toilet seat lid folding action to occur; and wherein the seat lid rear half rests against the front surface of the upper tank half and the seat lid front half rests against the seat lid rear half to remain out of the way of the user during use, while still allowing for covering the bowl area for aesthetic, protective, and sanitary purposes when not in use.

2. The rearward-facing toilet, according to claim 1, wherein the tank assembly is made of a material selected from the group consisting of porcelain, polyvinyl chloride, or acrylonitrile butadiene styrene plastic.

3. The rearward-facing toilet, according to claim 1, wherein the upper end of the upper tank portion includes the flat top to allow the user to lean against during use.

4. The rearward-facing toilet, according to claim 1, wherein the bowl assembly is made of a material selected from the group consisting of porcelain, polyvinyl chloride, or acrylonitrile butadiene styrene plastic.

5. The rearward-facing toilet, according to claim 1, wherein an opening to the bowl interior is seven inches across, with a seat width of three and a half inches.

6. The rearward-facing toilet, according to claim 1, wherein the pair of foot ramps are foot ramps adapted to ergonomically accommodate a plurality of different sized users.

7. The rearward-facing toilet, according to claim 1, wherein the footrests include a plurality of molded ridges.

8. The rearward-facing toilet, according to claim 1, wherein the footrests are made of a texturized material.

9. The rearward-facing toilet, according to claim 1, wherein the pair of armrests are adapted to assist the user mounting or dismounting the rearward-facing toilet.

10. The rearward-facing toilet, according to claim 1, wherein the pair of armrests are adapted to rest a pair of user's arms during use of the rearward-facing toilet.

11. The rearward-facing toilet, according to claim 1, wherein the first button allows for a brief discharge of water to pre-wet the bowl area before use of the rearward-facing toilet prior to a bowel movement in an effort to make cleaning of the bowl area easier.

12. The rearward-facing toilet, according to claim 1, wherein the second button allows for a complete flush in a conventional manner.

* * * * *